US009896311B2

(12) United States Patent
Bang

(10) Patent No.: US 9,896,311 B2
(45) Date of Patent: Feb. 20, 2018

(54) METHOD AND SYSTEM FOR CONTROLLING A LOAD

(71) Applicant: Savant Tech AS, Stavanger (NO)

(72) Inventor: Knut E. Bang, Stavanger (NO)

(73) Assignee: Savant Tech AS, Stavanger (NO)

( * ) Notice: Subject to any disclaimer, the term of this patent is extended or adjusted under 35 U.S.C. 154(b) by 72 days.

(21) Appl. No.: 15/100,429

(22) PCT Filed: Nov. 28, 2014

(86) PCT No.: PCT/EP2014/075950
§ 371 (c)(1),
(2) Date: May 31, 2016

(87) PCT Pub. No.: WO2015/082347
PCT Pub. Date: Jun. 11, 2015

(65) Prior Publication Data

US 2016/0297650 A1 Oct. 13, 2016

(30) Foreign Application Priority Data

Dec. 2, 2013 (NO) ..... 20131594

(51) Int. Cl.
*B66C 13/08* (2006.01)

(52) U.S. Cl.
CPC ..... *B66C 13/085* (2013.01)

(58) Field of Classification Search
CPC ..... B66C 13/00; B66C 13/04; B66C 13/08; B66C 13/085
(Continued)

(56) References Cited

U.S. PATENT DOCUMENTS 1,645,079 A 10/1927 Titterington
3,608,384 A * 9/1971 Hardin ..... B66C 13/08 294/81.4
(Continued)

FOREIGN PATENT DOCUMENTS

EP 0802150 A1 10/1997
GB 2467149 A 7/2010
(Continued)

OTHER PUBLICATIONS

Machine Translation for JPH 07252087.*
(Continued)

*Primary Examiner* — Sang K Kim
*Assistant Examiner* — Juan Campos, Jr.
(74) *Attorney, Agent, or Firm* — Winstead PC

(57) ABSTRACT

A system for controlling the orientation of a hanging load, the system comprising a lifting frame (20) being connectable to a load to be lifted, on which lifting frame two or more flywheel units (9) are arranged, the flywheel units (9) each comprising a flywheel (10) rotary arranged in a gimbal (11) which again is rotary arranged in a gimbal support (15) along an axis of rotation (6) being perpendicular to the axis of rotation (8) of the flywheel (10), where an electric motor (12) is arranged for rotating the flywheel (10), and a tilting motor (13) is arranged to tilt the gimbal by rotating the gimbal about its axis of rotation (6), wherein the system further comprises a control unit for individually controlling the speed and the direction of rotation of the flywheels, and the tilting of the gimbals, the control system being adopted for re-initialization of a flywheel units (9) either by reducing the speed of rotation fully or partly, tilting the gimbals to a new starting position, and spinning up the flywheels again; or by stopping the flywheels and spinning up the flywheels in the opposite direction.

10 Claims, 11 Drawing Sheets

(58) Field of Classification Search
USPC ..... 212/272
See application file for complete search history.

(56) References Cited

U.S. PATENT DOCUMENTS

| | | | |
|---|---|---|---|
| 5,816,098 | A | 10/1998 | Kanki et al. |
| 5,871,249 | A | 2/1999 | Williams |

FOREIGN PATENT DOCUMENTS

| | | | |
|---|---|---|---|
| JP | H02169493 | A | 6/1990 |
| JP | H07252087 | A | 10/1995 |
| JP | 2797912 | B2 | 9/1998 |

OTHER PUBLICATIONS

Machine Translation for JPH 02169493.*
Serôdio, Renato; International Search Report prepared for PCT/EP2014/075950 dated Feb. 13, 2015.

* cited by examiner

METHOD AND SYSTEM FOR CONTROLLING A LOAD

TECHNICAL FIELD

The present invention relates to a method and a system for controlling the position and movement of a load. More specifically, the present invention relates to a system and method for controlling the rotational movement of a load suspended in a lifting cable.

BACKGROUND ART

Control of rotation and accurate positioning of loads are important in handling loads by means of cranes. When using a single lifting cable the crane operator may control the load, or the centre of gravity of the load, in three dimensions, but not in a fourth dimension, the orientation of the load in the horizontal plane. To control and adjust the orientation of the load, manual adjustments or adjustments using auxiliary lines/wires has to be used. Manual handling/control of the orientation of loads may represent a significant hazard, especially if the load is heavy and/or have large dimensions along one or more axes. According to the Petroleum Safety Authority Norway, work involving cranes and the associated handling of the loads is the most common source of fatal accidents in the offshore industry. Thus, there is a need in the industry for a system to control the turning motion of a suspended load.

Additionally, it is often important to control the orientation of the load during the transfer of the load from the lift up position to the set down position, both to avoid physical hindrances and to ascertain that the orientation of the load is substantially correct to be set down to increase the efficiency.

The use of gyroscopic devices, i.e. devices based on spinning objects, for controlling the movement of different bodies, such as loads hanging in cranes or the like has been known for decades.

U.S. Pat. No. 1,645,079 relates to a stabilizer with two gyroscopic rotors and the use of the stabilizer for bomb-sights, cameras etc. in aircrafts. The device may be efficient in stabilizing a bomb-sight, camera or the like, but active relocation of the item to be stabilized from one orientation to another, is not described.

U.S. Pat. No. 5,871,249 describes a stable positioning system for a suspended payload, where a unit comprising a plurality of flywheels having axes of rotation being aligned with the three orthogonal axes. The system allows for stabilization of a suspended load but not for controlling the position and movement of a load.

The mentioned prior art is based on stabilization using the gyroscopic effect. The gyroscopic effect is well known in physics, and is based on the fact that if you apply a torque to a spinning object, the angular momentum will move in the direction of the torque. This means that if a torque $\tau$ is applied through the forces F in the vertical plane as shown in FIG. 1 the angular momentum L will move toward the torque and cause the spinning object to turn in the horizontal plane. Applied on a hanging load, this turning movement is a movement spinning around an axis of its own. FIGS. 2*a*) and *b*) illustrate two different arrangements of two spinning objects W, W' on a load A having a center of gravitation at "X", seen from above. Applying a force F, as illustrated in FIG. 1, to the spinning objects for a given duration, will create a torque in the direction indicated by the arrows. The torque will cause rotation of the load that is independent on the distance of the spinning objects from each other or from the center of gravity of the load. The torque is dependent on the spin and inertia of the spinning objects. The inertia of the spinning objects may be increased by increasing the rotation of the spinning objects, moving as much weigh as far as possible out from the axis of rotation, and increasing the weight of the spinning objects. Increasing the inertia of the spinning objects has its obvious limitations in the space available for this purpose, as have the total weight of the spinning objects, and the obtainable speed of rotation.

The torque creating effect on a load by tilting the spinning objects is limited as the torque will be oppositely directed when the spinning object is tilted more than 90 degrees from its starting position. The spinning objects then have to be repositioned relative to the body to be controlled, to be able to continue the required torque on the load. Clutches for disconnecting the load from the action of the spinning body, or reducing the speed of the spinning body for repositioning, have been proposed in the prior art.

U.S. Pat. No. 5,816,098 describes a lifting load attitude control system built on the principles above, the system comprising a flywheel suspended in a gyro frame to form a flywheel unit. Two or more flywheel units may be used together to increase the attitude control forces available. A clutch may be arranged between the flywheel unit and the load to be able to rotate the load independent of the flywheel unit. Disconnecting the load from the flywheel by the use of clutches for repositioning the flywheel has the negative effect of losing control of the load and its rotation for the time the load is disconnected.

Reducing the speed of the flywheel as in patent JP2797912 over the part of the rotation/tilt cycle where the torque from the flywheel is induced in the wrong direction of the intended one, will reduce the achieved rotational torque, and at best provide an alternating torque for load rotation.

An objective of the present invention is to provide a method and a system solving the non-solved problems according to the prior art solutions. More specifically, an objective of the present invention is to provide a method and system for controlling the rotation and thus the orientation of a hanging load, and to restart a rotation of the load towards a wanted orientation after a rotation of the load has been stopped or disturbed by external forces.

SUMMARY OF INVENTION

According to a first aspect, the present invention relates to a system for controlling the orientation of a hanging load, the system comprising a lifting frame being connectable to a load to be lifted, on which lifting frame two or more flywheel units are arranged, the flywheel units each comprising a flywheel rotary arranged in a gimbal which again is rotary arranged in a gimbal support along an axis of rotation being perpendicular to the axis of rotation of the flywheel, where an electric motor is arranged for rotating the flywheel, and a tilting motor is arranged to tilt the gimbal by rotating the gimbal about its axis of rotation, wherein the system further comprises a control unit for individually controlling the speed and the direction of rotation of the flywheels, and the tilting of the gimbals, the control system being adopted for re-initialization of the flywheel units either by reducing the speed of rotation fully or partly, tilting the gimbals to a new starting position, and spinning up the flywheels again; or by stopping the flywheels and spinning up the flywheels in the opposite direction. The skilled person will understand that the tilting of the gimbals are controlled to create a torque to rotate the lifting frame and any attached load towards a required or predetermined orientation. The orientation of a lifting frame and any load attached thereto is the orientation of any substantially horizontal axis with respect to either a global or a local reference system. The expression "required orientation" or the "predetermined orientation" is used to describe the orientation the load should have at a given time, and can be used to indicate predetermined orientation, or a position determined by different factors, such as a lift up orientation, set down orientation, or an orientation to avoid hitting permanent objects or objects temporally present in or close to the path to be followed by the load.

The expression "re-initialization" with regard to the flywheels and flywheel units is used to describe the actions needed to give the flywheel units additional potential for creating a torque after the flywheels of the flywheel units have been tilted for creation of a torque until further tilting results in a torque with a horizontal component in the opposite direction of the starting torque. To re-initialize the flywheel units, the flywheels have to be stopped and the rotation started in the opposite direction, or the flywheels have to be stopped, tilted back to the start position or another position, and the rotation restarted. The flywheels may then be tilted again in the direction resulting in a torque to rotate the lifting frame and any load attached thereto in the required direction. Stopping and starting of flywheels when the system is in rotational motion is preferably done when the flywheels are essentially lying horizontally and they are in positions of low potential impact on sideways torque. The skilled person will understand that for an embodiment where the flywheel is stopped, tilted back to another position and rotation restarted, the stopping of the rotation of the flywheel may be a full or partly stopping where a partly stopping is a substantial reduction of the speed of rotation.

The control unit is adopted to control the speed of rotation, so that e.g. a resting flywheel may be spun up to take over for a flywheel when its ability to cause a rotating force in the wanted direction is exhausted. The first flywheel may then be stopped, rotated to a new starting position, spun up again to re-initiate the flywheel to create more rotating force in the required direction, to obtain a semi-continuous or continuous rotating force in the required direction, or to restart the rotation of the load if external forces have stopped the rotation in the required direction.

The expression "gimbal" is used to denote any pivoted support for a flywheel allowing the flywheel to rotate about an axis of rotation. The shape of the gimbal is not important as long as it allows for rotation of the flywheel. The gimbal is supported in a gimbal support allowing rotation of the gimbal about an axis of rotation being perpendicular to the axis of rotation of the flywheel. The skilled person will understand that the expression "flywheel unit" is used for a unit comprising a flywheel, a gimbal, and a gimbal frame and necessary motors for controlling the rotation of the flywheel and the tilting of the flywheel in the flywheel unit.

According to one embodiment, the system comprises flywheels arranged in pairs and where each pair of flywheels is arranged to be rotated in a direction opposite of each other. The force created by tilting the flywheels may be decomposed into a force directed in the horizontal plane in the direction of required rotation for the load, and a vertically directed force tilting the load. Rotating the flywheels in a pair in opposite directions will cause the tilting force from the pair to neutralize each other. Accordingly, rotation in the opposite direction is used herein to denote rotation of a pair of flywheels resulting in a torque in the horizontal plane that are directed the same way and vertically directed forces directed to counteract each other's.

According to another embodiment, the system further comprises one or more navigation instruments for determining the rotation, movement and/or orientation of the hanging load, where the navigation instrument(s) is (are) connected to the control unit.

According to yet an embodiment, one or more battery(ies) is (are) arranged in the system for operation of the electrical motors therein, and where the electrical motors are adopted to charge the batteries when stopping the rotation of the flywheels. Using battery-operated motors, no electrical connection from the outside is necessary. Using the force used to stop the flywheels for charging the batteries, makes it possible to reduce the battery capacity and/or to make it possible to extend the period for operation between changing, substantially.

According to one embodiment, the system comprises communication unit for communication with a remote control unit.

According to one embodiment, the remote control unit is a remote control. Alternatively the remote control unit is a computerized control system automatically controlling the orientation According to an alternative embodiment, the control unit is pre-programmed to control the orientation of the load as a function of data collected from sensors arranged on the system. Said sensors may be sensors for detection of position, speed, rotation and/or orientation of the system and load, sensors for detection of proximity to solid objects.

According to a second aspect, the invention relates to a method for controlling the orientation of a hanging load, comprising the steps of:

connecting a lifting frame on which two or more flywheel units are arranged, the flywheel units each comprising a flywheel rotary arranged in a gimbal which again is rotary arranged in a gimbal support along an axis of rotation being perpendicular to the axis of rotation of the flywheel, where an electric motor is arranged to control the speed and direction of rotation for the flywheel, and a tilting motor is arranged to tilt the gimbal by rotating the gimbal about its axis of rotation, to a load connecting the lifting frame to a lifting cable being connected to a crane, lifting the lifting frame and the thereto connected load by means of the crane and the lifting cable, spinning up flywheels and tilting the flywheels by tilting the gimbals to create a torque acting on the lifting frame and the load, wherein the method further comprises the steps of:

re-initialization of one or more of the flywheels, either by reducing the speed of rotation fully or partly, tilting the gimbals to a new starting position, and spinning up the flywheels again, or by stopping the flywheels and spinning up the flywheels in the opposite direction.

According to one embodiment, the flywheels are re-initiated by reducing the speed of rotation or stopping the rotation of the flywheels, tilting the flywheels to a new starting orientation, and restarting the rotation of the flywheels in positions of low potential impact on sideways torque.

According to another embodiment, the flywheels are re-initiated by stopping the rotation of the flywheels in positions of low potential impact on sideways torque and restart the rotation in the opposite direction.

According to still an embodiment, the flywheels are grouped in pair(s) of flywheels, and where two or more pairs of flywheels are used to obtain a substantially continuous operation of the orientation system, by re-initiating one pair of flywheels while a different pair of flywheels are in operation.

According to another embodiment, the rotation and tilting of the flywheels are controlled by means of computerised central unit.

DETAILED DESCRIPTION OF THE INVENTION

Figure 1:
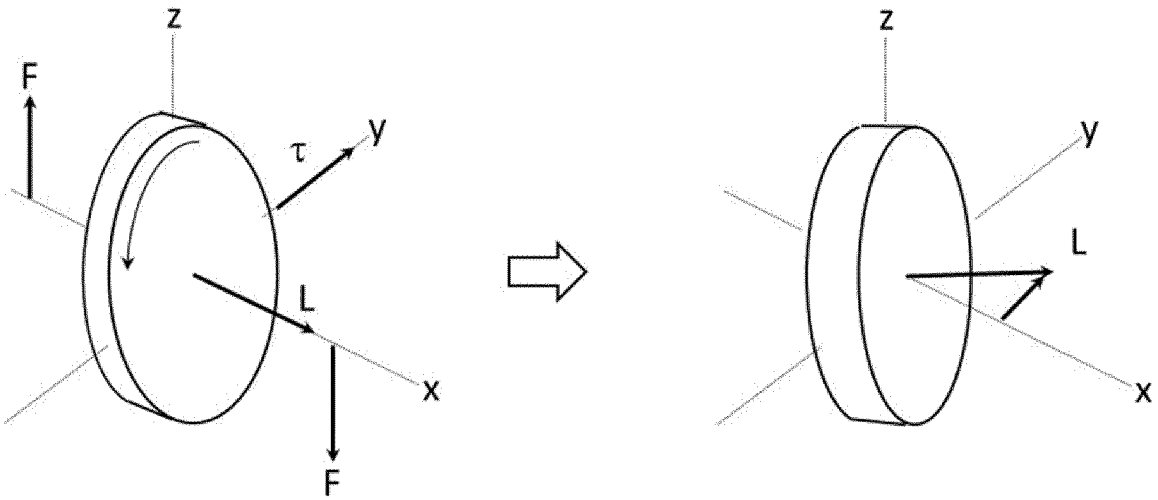
FIG. 1 is an illustration of the effect of applying a torque to a spinning object.
Figure 2:
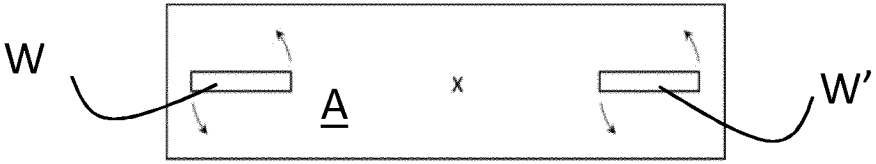
FIG. 2 is an illustration of the rotational forces in the horizontal plane by applying a torque to two rotating objects.
Figure 2:
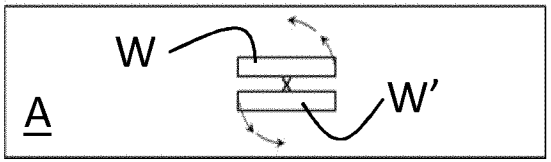
Figure 3:
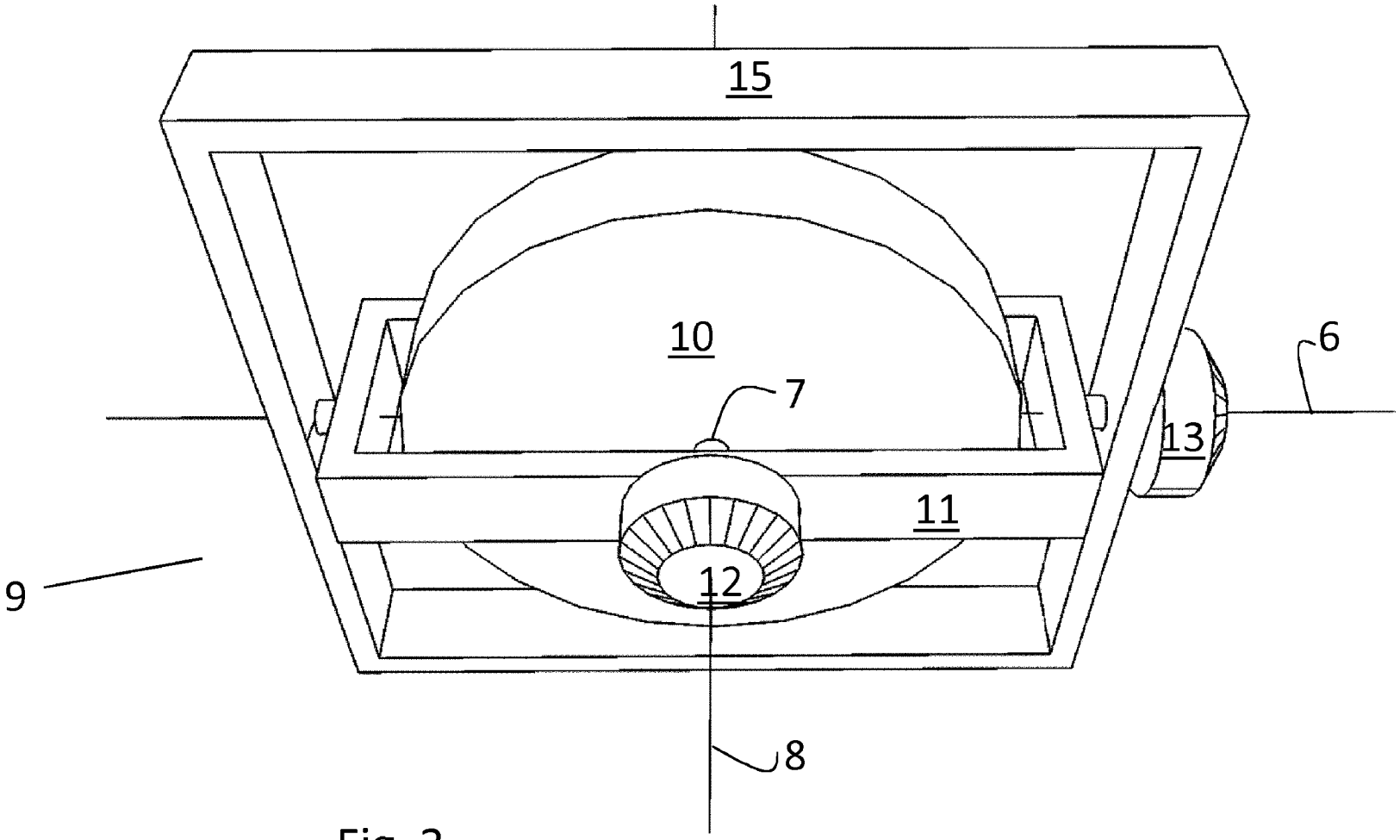
FIG. 3 is an perspective view of a flywheel unit as used in the present invention.

FIG. 3 illustrates a flywheel unit 9, comprising a flywheel 10 arranged in a gimbal 11. The rotation of the flywheel is controlled by means of an electrical motor 12, connected to a control system via not shown cables. The flywheel is rotatable about an axis of rotation 8. In the illustrated embodiment, the electrical motor and the flywheel has a common axis of rotation 8. The skilled person will understand that a gear or the like may be arranged between the electrical motor 12 and a flywheel shaft 7, without leaving the scope of the invention. The skilled person will also understand that the term "flywheel" is to be understood as any convenient spinning object being balanced about an axis of rotation.

The gimbal 11 is again rotary arranged in a gimbal frame 15. The gimbal 11 is rotary arranged about a gimbal frame axis of rotation 6 being substantially perpendicular to the axis of rotation for the flywheel preferably in or close to the centre of gravity of the flywheel.

The rotation of the gimbal 11 in the gimbal frame 15 is controlled by means of a tilting motor 13. The tilting motor 13 may be any kind of electrical motor that is capable of tilting the gimbal 11 to predetermined angles about the gimbal's axis of rotation, as determined by a control unit.

The flywheel unit 9 may be controlled by adjusting the rotational speed and direction of rotation of the flywheels by means of the electrical motor 12, and by tilting, or rotation, of the gimbal 11 relative to the gimbal frame 15 by mean of the tilting motor 13.

Figure 4:
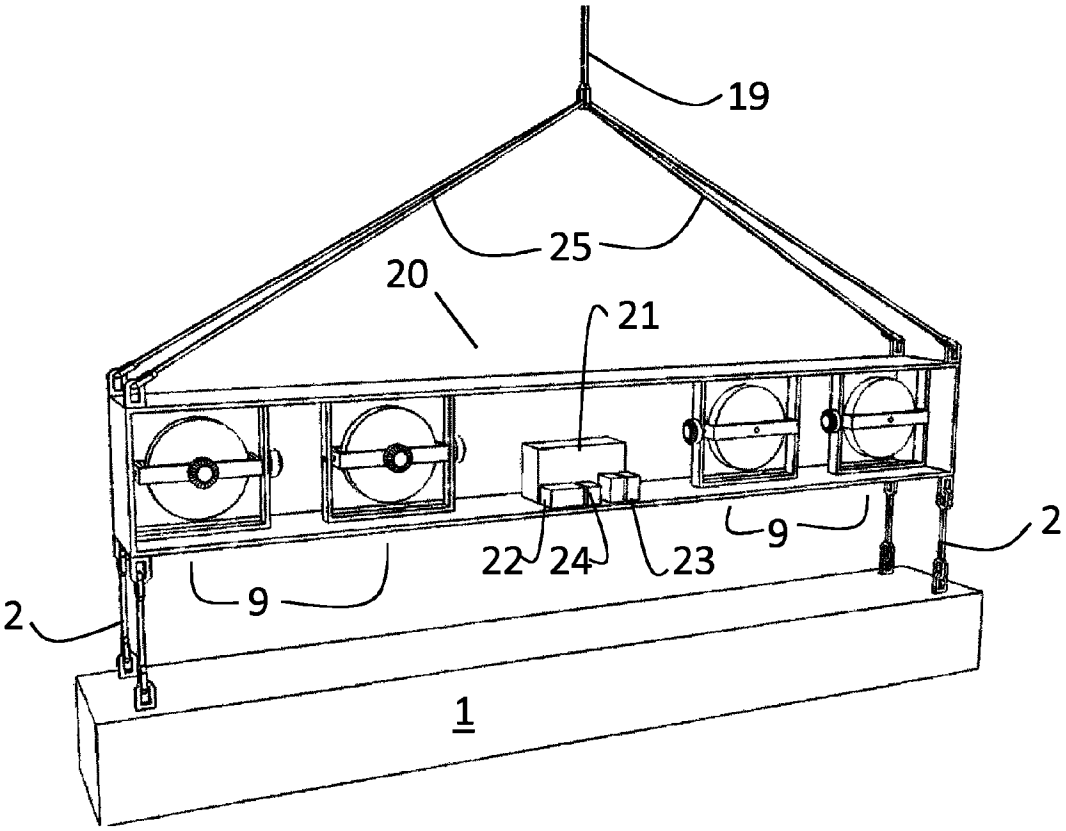
FIG. 4 is a perspective view of a lifting frame according to the invention suspended in a lifting cable, and a load connected to the lifting frame.

FIG. 4 is an illustration of a lifting frame 20 according to the present invention. The lifting frame 20 is suspended in a lifting cable 19 from a not illustrated crane or other lifting device. The skilled person will understand that the cable may be substituted by a wire, rope, chain, rod or the like without leaving the scope of protection. The crane or lifting device may be any type of crane suitable for lifting the intended load. The load position unit is connected to the lifting cable, wire, rope or the like by means of engaging linkages 25. The skilled person will understand that the engaging linkages 25 may be chains, wires, ropes, bars, or the like without leaving the scope of the invention. Alternatively the lifting frame may be connectable to a load by other means, such as magnets, grips, etc., dependent on the shape and nature of the load to be lifted.

The lifting frame 20 of FIG. 4 comprises four flywheel units 9 of the type illustrated in FIG. 3. Additionally, a battery pack 21 for operating the flywheel units 9 and any additional equipment requiring electrical power at the lifting frame 20 is provided. The additional equipment mentioned above may comprise one or more control unit(s) 22 for controlling the flywheel units 9 to obtain the required actions, a transmitter 23 to receive control signals from a remote operation panel, and optionally to send data to a remote operation panel, one or more navigation instruments 24, such as a gyroscope, accelerometer, compass/magnetometer or GPS or locally arranged navigation systems for accurate determination of the position, orientation and rotation speed of the lifting frame and the load. The skilled person will know which of the mentioned equipment that has to be interconnected and how to connect them.

The lifting frame 20 does also comprise connectors 2 for connecting the lifting frame to a load 1. The connectors illustrated in FIG. 4 are chains, but the skilled person will understand that the connectors may by any type of conventionally used connectors, such as conventional, widely used container connectors, rods as illustrated in FIG. 4, gripping tools as illustrated in FIG. 12 or the like.

Figure 5:
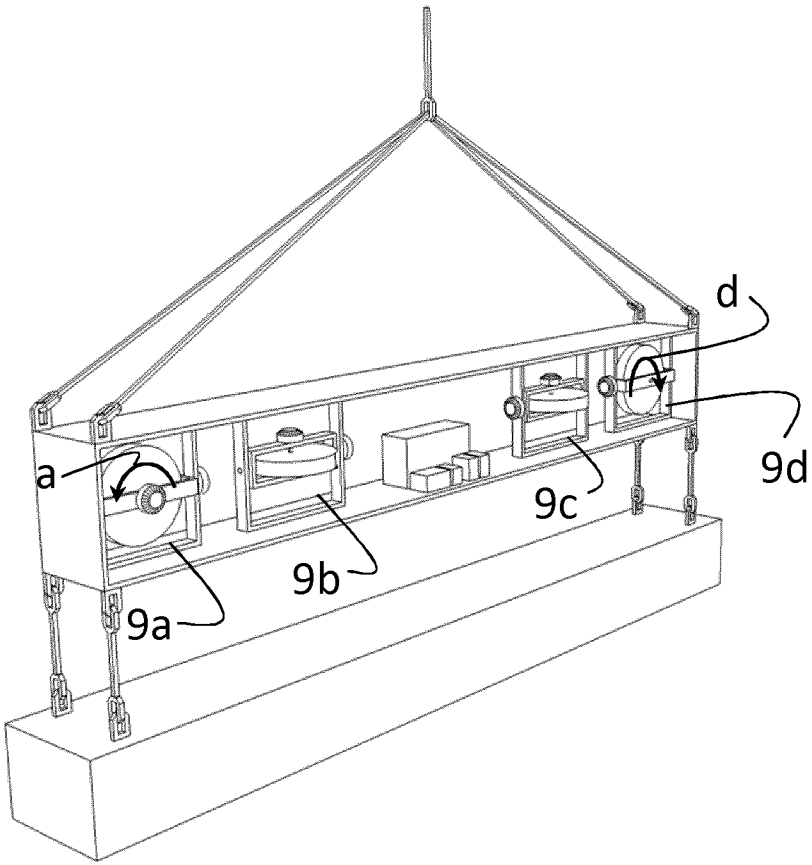
FIG. 5 is an illustration of a first step in the operation of the flywheel units.
Figure 6:
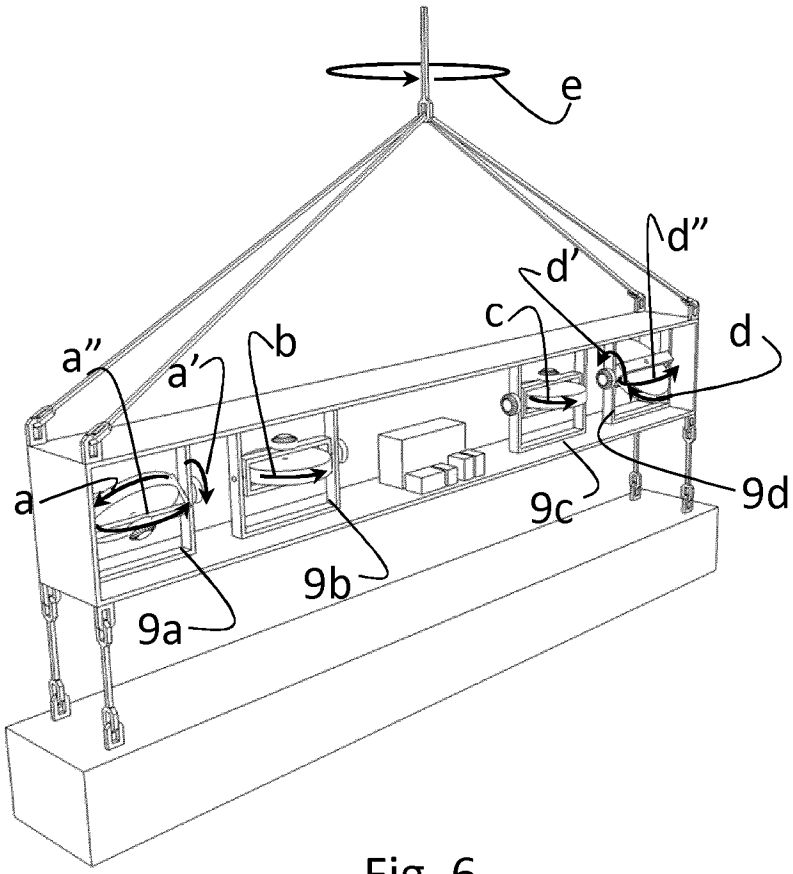
FIG. 6 is an illustration of a second step in the operation of the flywheel units.
Figure 7:
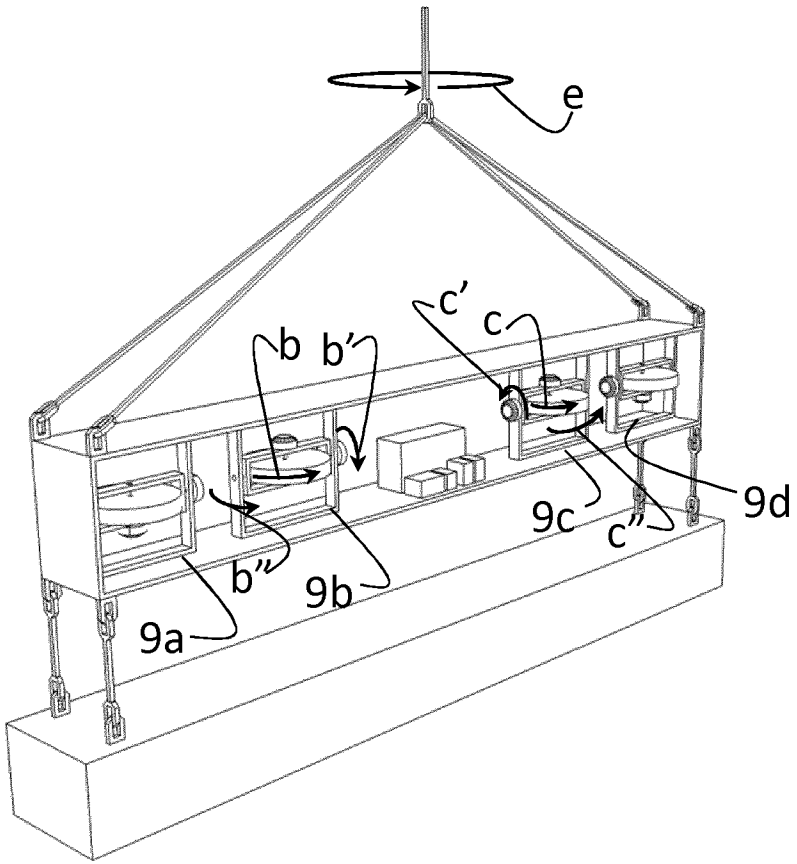
FIG. 7 is an illustration of a third step in the operation of the flywheel units.

FIGS. 5 to 7 illustrate different steps in operation of an embodiment of the present lifting frame 20 comprising four flywheel units 9, identified with 9*a*, 9*b*, 9*c* and 9*d*, respectively, in FIGS. 5 to 7. All the flywheel units are arranged so that the gimbals' axis of rotation 6, are substantially parallel with the length axis of the lifting frame. FIG. 5 illustrates a starting position where two of the flywheel units, 9*a* and 9*d* are arranged so that their axis' of rotation are substantially parallel with the lifting frame, or substantially horizontally arranged, whereas the other two flywheel units 9*b* and 9*c*, are arranged so that the axis of rotation for the flywheels are substantially vertical or perpendicular to the lifting frame.

Starting from the position illustrated in FIG. 5, two of the flywheels are rotated up to a predetermined speed of rotation that is calculated to give the required torque during the operation. Preferably, the two flywheels in units 9*a* and 9*d* are rotated in opposite direction as indicated with arrows a, d on the flywheels, to maintain the balance in the lifting frame, so that the vertical forces caused by tilting the spinning flywheels counteracts each other's. Spinning up the flywheels of units 9*a* and 9*d* when their axis of rotation are substantially horizontal, will stabilize the orientation of the flywheel's relative to the lifting frame and any load attached thereto. The flywheels will counteract any rotation of the load about or substantially parallel to the lifting cable by the gyroscopic effect caused by the spinning wheels. The skilled person will understand that the orientation of the flywheels may be different from the orientation described above during start-up, if required.

As soon as the flywheels in units 9*a* and 9*d* have arrived at their predetermined speed of rotation, the flywheels may be tilted for obtaining a torque for a required rotation of the lifting frame and any load attached to the lifting frame. If the flywheels in units 9*a*, 9*d* are spinning in opposite directions, the flywheels are tilted oppositely of each other to obtain a torque for turning the load in the same direction.

FIG. 6 illustrates a second step of operation of the present lifting frame, where the flywheels in units 9*a* and 9*d* are tilted in the directions indicated by arrows a' and d', to result in a torque to counteract the tilting of the respective flywheel. This torque may be decomposed in a force tilting the lifting frame and the load connected to it, and a torque a" and d", respectively, directed in the horizontal plane to rotate the lifting frame and the load connected to it. The torques a" and d" add to each other to a torque indicated by arrow e) causing the lifting frame and load to rotate. By rotating the two flywheels in opposite direction, the tilting forces on the lifting frame caused by the tilting of the flywheels counteract each other.

As mentioned above in the introductory part of the description, the torque resulting from tilting the flywheels more than 90° will be directed in the opposite direction relative to the initial direction of the torque. Accordingly, the flywheel units have to be re-initiated to be able to continue causing a torque in the same direction after being tilted 90°.

Re-initiation may be effected either by stopping or substantially reducing the speed of rotation of the flywheels, tilting the flywheels back into the start position or another position, and restarting/accelerating the flywheels in the original direction of rotation; or by stopping the flywheels and restarting the flywheels in the opposite direction of rotation. The skilled person will understand that the two options for re-initialization are equal from a physical point of view, and the choice between the options will be a choice to give the most practical solution.

To maintain a torque, or at least the possibility to cause a torque during re-initialization of the flywheels 9*a* and 9*d*, the flywheels of units 9*b* and 9*c* are then spun up to take over from the flywheels in units 9*a* and 9*d* to take over as soon as the flywheels in units 9*a* and 9*d* approaches a tilting angle of 90° from the start position of FIG. 5, as the flywheels were started up with horizontal axis' of rotation.

The axis of rotation for both the flywheels of units 9*b* and 9*c* are during the spinning up operation, vertical and parallel with the axis of rotation of the load caused by torque from the units 9*a* and 9*d*. Accordingly, the spinning up of the two flywheels causes no torque affecting the torque caused by the tilting of the flywheels in units 9*a* and 9*d*.

FIG. 7 illustrates a third step where all the flywheels of units 9*a* to 9*d* rotate about axis of rotation that are vertical, and where the flywheels of units 9*a* and 9*d* have been tilted 90°. Further tilting of the flywheels will cause the torque to be directed opposite of the direction in the starting phase, and the flywheel units have to be re-initialized to be used for further creation of a torque in the requested direction. For a unit having four flywheel units operated in pairs, one pair is active in creation of the torque while the other pair of flywheel units is inactive. As soon as the first pair of flywheel units 9*a* and 9*d* approaches 90° tiling from the starting position, the flywheels of units 9*b* and 9*c* are spun up and takes over the duty of the flywheels of units 9*a* and 9*d*, which are stopped. The stopped flywheels may then be tilted back 180°, and then spun up again, or spun up in the opposite direction without being tilted first, to take over when the flywheels of the units 9*b* and 9*c* have been tilted 180° to cause a torque e) of the load and lifting frame according to the need thereof.

By repeating said steps of starting a pair of flywheels, tilting, re-initialization while the other pair of flywheel units takes over to create the required torque, a substantially continuous force for rotating the lifting frame may be obtained. The skilled person will, however, understand that in situations where a higher torque is needed for starting up or stopping rotation of a lifting frame and a load, all four flywheels may be controlled to cooperate to give a sufficient torque for the operation in question. In some kind of operation, the flywheels may be used to control the rotation of the lifting frame and load both back and forth to obtain the required orientation thereof. All flywheels may then be used to obtain a torque sufficient to give a fast and efficient reorientation of the lifting frame and load. The skilled person will also understand that the flywheels do not have to be completely stopped before they are tilted to a new starting position, and that the speed may be reduced sufficiently to reduce the torque caused by tilting to a fraction of the torque caused by tilting by a flywheel at higher speed of rotation. The skilled person will also understand that the speed of rotation of the flywheels may be varied according to the required torque to be obtained.

In addition to adjusting the orientation in take up and set phases of lifting, the present system may be used to adjust the orientation of a load to avoid hitting building elements or other elements in the route of the load. The in-route adjustment of position may be important for making lifting operations more efficient and may be of outmost importance for lifting of elongated bodies, to avoid that the load and/or other objects on its way are damaged. Today auxiliary ropes or wires fastened to the load are often used for this purpose. The present lifting frame makes it possible to obtain required and/or predetermined orientations of the load/lifting frame automatically or by manually operating the remote control without using such auxiliary means.

The rotating of a load to change the orientation thereof may be disturbed by the wind or by hitting objects that stops or at the least has a substantial influence on the required rotation. The present lifting frame including the flywheel units allowing fast and efficient reposition and spinning up of the flywheels, the torque to continue the required re-orientation of the lifting frame with or without a load, may be rapidly obtained.

As indicated above, a battery unit 21 is provided on the lifting frame 20 for operating the control unit, sensors for detection of precise position and orientation of the load and lifting frame, such as local positioning systems, GPS, sensors for detection of objects, etc., in addition to the electrical motors 12 and the tilting motors 13. The battery capacity may be a limiting factor for the time of operation of the present system. However, not shown power cables connected to the lifting frame may provide for electrical power to the lifting frame.

The battery capacity may also be extended by using the electrical motor 12 as an electrical brake, i.e. as a generator, for producing power for charging of the battery when the flywheel is stopped or the speed of rotation is to be reduced.

Figure 8:
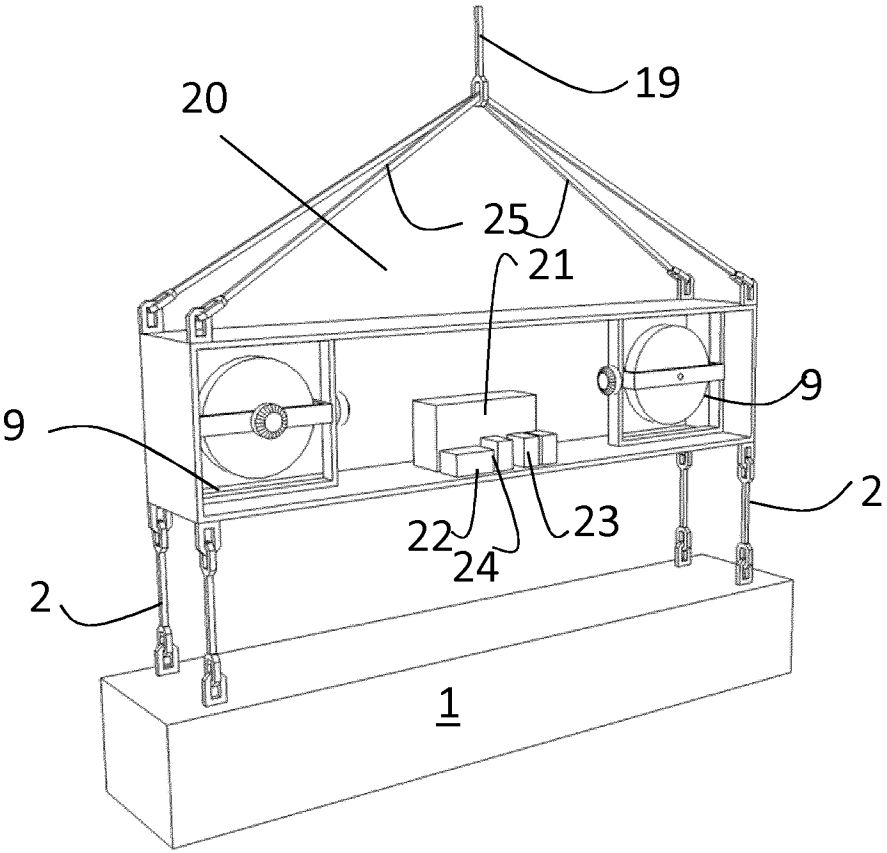
FIG. 8 is an illustration of an alternative embodiment of the present invention.
Figure 9:
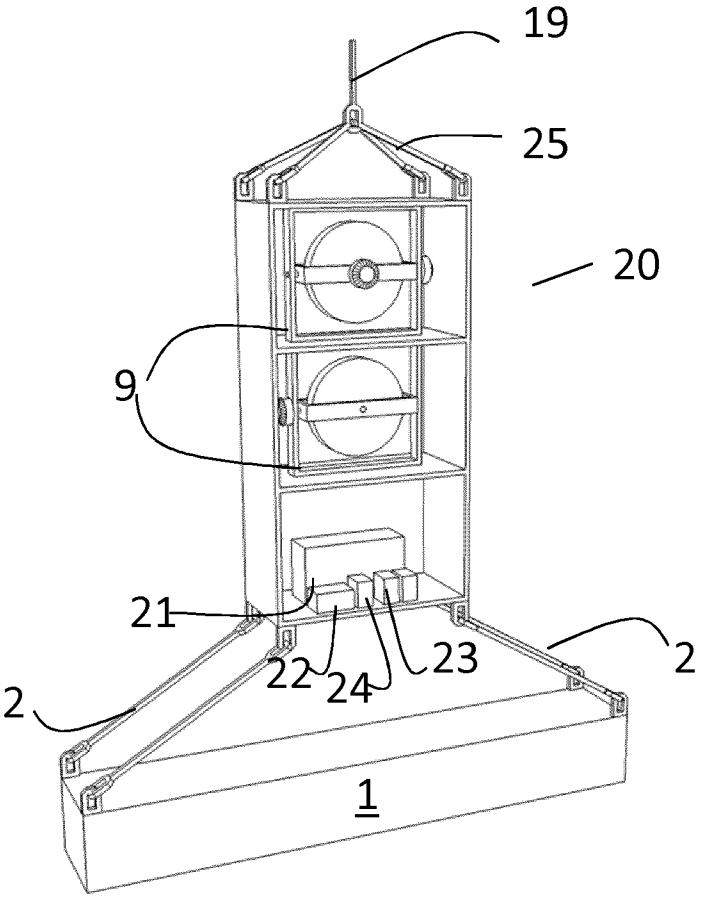
FIG. 9 is an illustration still an embodiment of the invention.

FIGS. 8 and 9 illustrate alternative embodiments of the present lifting frame, where FIG. 8 illustrates a lifting frame only comprising two flywheel units arranged in a frame corresponding to the embodiment illustrated in FIGS. 3 to 7.

FIG. 9 also illustrates an embodiment comprising two flywheel units, but where the flywheel units are arranged one at the top of the other to make a high and "slim" version of the lifting frame.

For any of the above-mentioned embodiments, a clutch may be provided between the tilting motor and the gimbal to be able to disconnect the tilting motor in cases where it is necessary to do minor manual adjustments of the orientation of the load, to avoid that the spinning flywheels counteract against the manual adjustments.

The skilled person will understand that the units only comprising two flywheel units are not able to produce a high continuous torque, as the flywheels have to be stopped and spun up in the opposite direction, or stopped, reverted to a new starting position and then spun up again, to give a semi-continuous action. The skilled person will also understand that the present system may comprise more than four flywheels, such as 6, 8, 10. Increasing the number of flywheel units may make it possible to reduce the diameter of each of the flywheels. However, a higher number of flywheel units will add to the complexity and the cost of the system. It is therefore currently assumed that it is preferred with four flywheel units for most applications.

Figure 10:
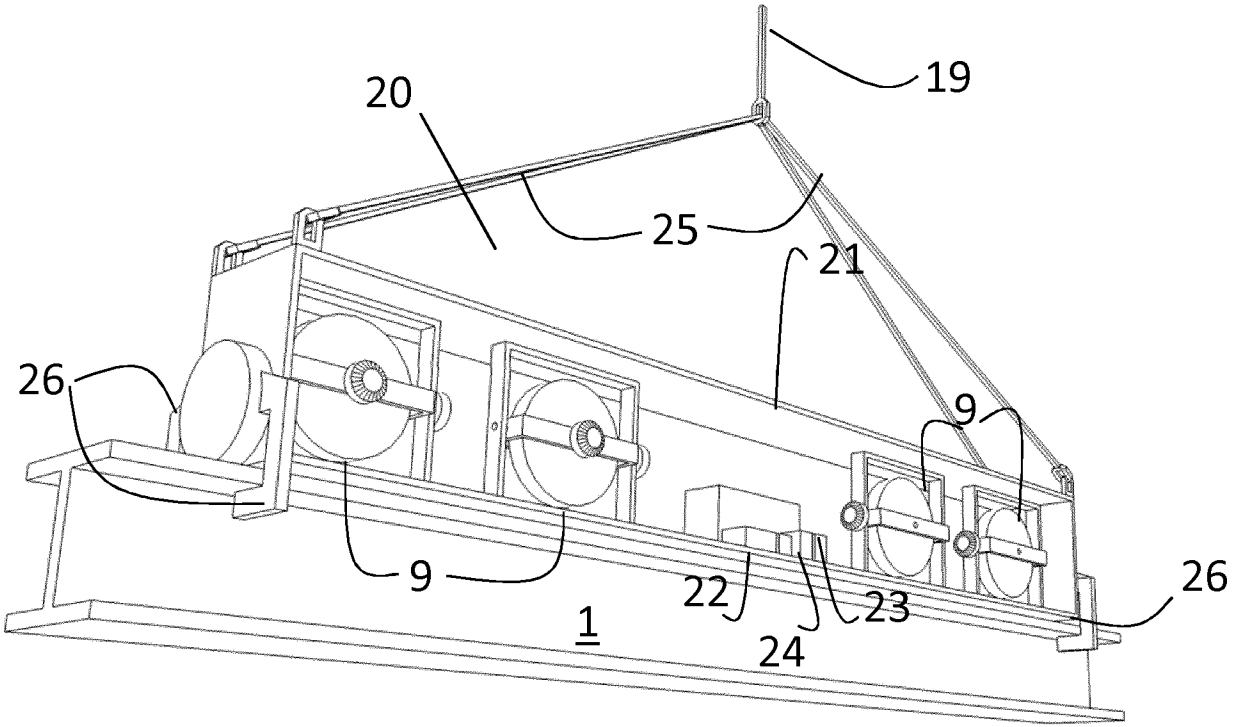
FIG. 10 is an illustration of an embodiment having gripping means to grip a load.

FIG. 10 illustrates a lifting frame having gripping tools 26 to grip a beam. However, the skilled person will understand that the gripping tool may be modified for lifting of other objects, such as pipes, logs, etc.

Figure 11:
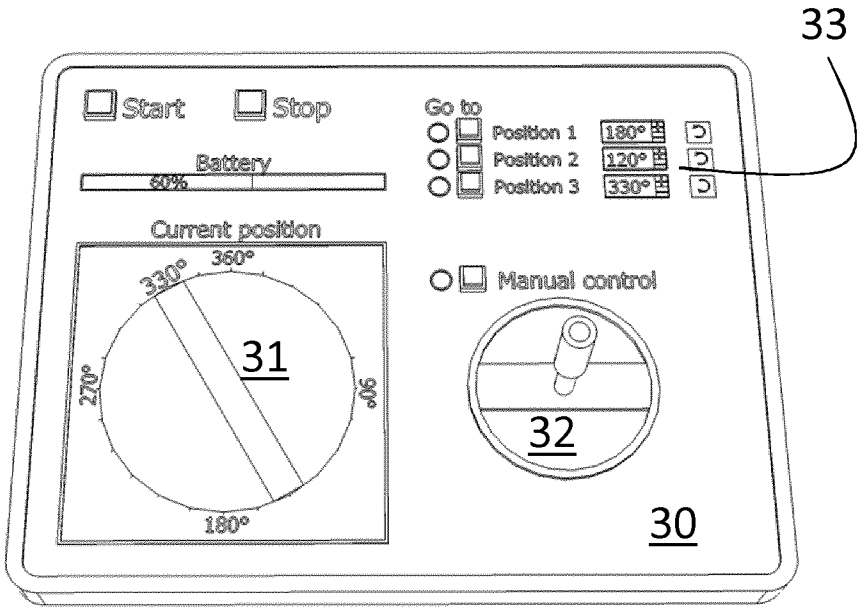
FIG. 11 is illustration of one alternative embodiment of a remote control for the present system.

The present lifting frame 20 is preferably remotely controlled by means of a remote control 30 e.g. as illustrated in FIG. 11 that communicates with the control unit on the lifting frame via the above mentioned transmitter therein. The remote control illustrated in FIG. 11 comprises an orientation indicator 31, for indication of the orientation of the lifting frame and thus the load either according to standard geographical orientation or according to a local grid for orientation. The indication of orientation by the indicator 31 may be based on information received from the control unit at the lifting frame. The information on orientation may alternatively be received from permanent sensors arranged in the area in question and/or sensors arranged on the lifting frame. As a further alternative, the information of orientation may be received from a combination of sensors and information received from the control unit that is collecting and making calculations based on information received from a GPS or any other global or local system for determining the three dimensional position and orientation of an object. The skilled person will understand that different systems for determining position and orientation of an object may be combined. As an example, a GPS system may provide sufficient information during one phase of an operation, whereas a local and more precise system may be used in the phases of picking up or putting down a load to provide the sufficient degree of accuracy.

The remote control may comprise a manual control 32 for manually controlling the orientation of the lifting frame or lifting frame and load, or may comprise a panel 33 for setting predetermined orientations so that the operator may select a pre-set orientation for a given position of the load. Additionally, the remote control may be provided with start and stop buttons, and an indicator for indicating the charging status of the battery on the lifting frame. The remote control 30 may be an independent unit for adjusting the orientation of the lifting frame and any load attached thereto. Alternatively, the remote control 30 may be combined with a remote control for controlling the lifting device, such as a crane.

Independent on if the remote control is in a manual modus or the lifting frame is operated in an automatic or pre-programmed modus, the control unit 22 is a key to efficient operation of the lifting frame. The control unit 22 is programmed to receive input from devices registering position and orientation of the lifting frame and any load attached to the lifting frame, input from any remote control etc., calculate which actions are to be taken based on the incoming data, and control the flywheel units to keep the lifting frame and any load in the required position, and/or to obtain the required re-orientation of the lifting frame and any load.

For certain lifting purposes where loads always are picked up from a limited number of locations, and are to be put into a limited number of predetermined put down positions, the orientations at different positions during the lifting operation may be pre-programmed so that the operator only has to select among pre-set programs, for each specific operation.

Even though the present invention is described above with reference to a lifting frame, the system for controlling the orientation to a load may be connected directly to the load without being a part of any lifting frame.

The skilled person will also understand that the flywheel units, the control unit, battery etc., preferably are protected by means of a cover, housing or the like. The skilled person will also understand that some of the components of the system for controlling the orientation of a load are not ex-certified. However, any non-ex certified parts might be encapsulate in an ex-protective box if the system is to be used in an area where ex-certification is required.

The skilled person will understand that the present system may be used both in connection with a manual remote control where the operator may control the flywheel parameters, such as speed of rotation, tilting, starting and stopping of the flywheels; a semi-automatic remote control where the control unit calculates the flywheel parameters necessary to obtain the operator's instructions via the remote control; or an automatic system being programmed to bring the lifting frame and the load into predetermined orientations at pre-set positions along a route.

The invention claimed is:

1. A method for controlling the orientation of a hanging load, the method comprising:

connecting a lifting frame on which two or more flywheel units are arranged, the flywheel units each comprising a flywheel rotary arranged in a gimbal which again is rotary arranged in a gimbal support along an axis of rotation being perpendicular to the axis of rotation of the flywheel, where an electric motor is arranged to control the speed and direction of rotation for the flywheel, and a tilting motor is arranged to tilt the gimbal by rotating the gimbal about its axis of rotation, to a load;

connecting the lifting frame to a lifting cable being connected to a crane;

lifting the lifting frame and the thereto connected load via the crane and the lifting cable;

spinning up flywheels and tilting the flywheels by tilting the gimbals to create a torque acting on the lifting frame and the load;

wherein the flywheels are grouped in pair(s) of flywheels, and where two or more pairs of flywheels are used to obtain a substantially continuous operation of the orientation system, by re-initiating one pair of flywheels while a different pair of flywheels are in operation; and reinitiating at least one of the flywheels, either by reducing the speed of rotation fully or partly, tilting the gimbals to a new starting position, and spinning up the flywheels again; or by stopping the flywheels and spinning up the flywheels in the opposite direction.

2. The method of claim 1, wherein the flywheels are re-initiated by reducing the speed of rotation or stopping the rotation of the flywheels, tilting the flywheels to a new starting orientation, and restarting the rotation of the flywheels in positions of low potential impact on sideways torque.

3. The method of claim 1, wherein the flywheels are re-initiated by stopping the rotation of the flywheels in positions of low potential impact on sideways torque and restart the rotation in the opposite direction.

4. The method according to claim 1, wherein a clutch is provided between the tilting motor and the gimbal for disconnection of the tilting motor to be able to do minor manual adjustments for the orientation of the load.

5. The method according to claim 1, wherein the rotation and tilting of the flywheels are controlled via computerised central unit.

6. The method according to claim 5, wherein the central control unit is programmed to calculate actions to be taken based on incoming data from devices for registration of position and orientation of the lifting frame and any load attached thereto, and control the flywheel units to keep the lifting frame and any load in the required position, and/or to obtain the required re-orientation of the lifting frame and any load.

7. The method according to claim 1, wherein the rotation and tilting of the flywheels are controlled to adjust the orientation of the load to avoid hitting building elements or other objects in the route of the load.

8. The method according to claim 1, comprising obtaining information on the three dimensional position and orientation of the load from a GPS or any other global or local positioning system.

9. The method according to claim 1, wherein the orientation of the lifting frame and load is controlled via a remote control.

10. The method according to claim 9, wherein the remote control is combined with a remote control for controlling the crane.

* * * * *